US011589679B2

(12) United States Patent
Dusek et al.

(10) Patent No.: US 11,589,679 B2
(45) Date of Patent: Feb. 28, 2023

(54) RETRACTABLE STORAGE DEVICES

(71) Applicant: Toyota Motor North America, Inc., Plano, TX (US)

(72) Inventors: Jeff E. Dusek, Arlington, MA (US); Adrian F. G. Botran, Key Biscayne, FL (US); Alison A. Palmer, Henrico, VA (US); Sabrina Tamames, Key Biscayne, FL (US); Colleen L. Casey, Grapevine, TX (US); Riley F. Keen, Plano, TX (US); David G. Walter, Aubrey, TX (US)

(73) Assignee: Toyota Motor North America, Inc., Plano, TX (US)

( * ) Notice: Subject to any disclaimer, the term of this patent is extended or adjusted under 35 U.S.C. 154(b) by 739 days.

(21) Appl. No.: 16/506,358

(22) Filed: Jul. 9, 2019

(65) Prior Publication Data

US 2021/0007494 A1 Jan. 14, 2021

(51) Int. Cl.
*A47C 7/62* (2006.01)
*A61G 5/10* (2006.01)

(52) U.S. Cl.
CPC ..... *A47C 7/624* (2018.08); *A61G 5/1094* (2016.11)

(58) Field of Classification Search
CPC ..... A47C 7/62; A47C 7/622; A61G 5/1094; A61G 5/10
See application file for complete search history.

(56) References Cited

U.S. PATENT DOCUMENTS 4,779,884 A * 10/1988 Minati ..... A61G 5/1094 280/304.1
4,944,552 A * 7/1990 Harris ..... B64D 11/06 297/145
5,035,464 A * 7/1991 Spallholtz ..... A47C 7/70 297/144
5,246,240 A * 9/1993 Romich ..... A61G 5/10 108/139
5,547,247 A * 8/1996 Dixon ..... A47C 7/70 297/145
5,799,964 A * 9/1998 Chao ..... A61G 5/1054 280/304.1

(Continued)

FOREIGN PATENT DOCUMENTS

CN 107468435 A 12/2017
DE 202004018466 U1 3/2005

*Primary Examiner* — Jacob D Knutson
*Assistant Examiner* — Conan D Duda
(74) *Attorney, Agent, or Firm* — Dinsmore & Shohl LLP

(57) ABSTRACT

A retractable storage device for an armrest of a chair, including a vertically extending arm assembly including a first distal end and a second distal end, a horizontally extending arm assembly including a first distal end and a second distal end, a middle connector, and a storage container. The second distal end of the vertically extending arm assembly is pivotally secured to the middle connector, and the first distal end of the horizontally extending arm assembly is pivotally secured to the middle connector. The retractable storage device is moveable between a stowed position and a raised position. The storage container is coupled to the second distal end of the horizontally extending arm assembly, where the storage container is stowed beneath the armrest when the retractable storage device is moved to the stowed position.

12 Claims, 5 Drawing Sheets

(56) References Cited

U.S. PATENT DOCUMENTS 6,427,957 B1 * 8/2002 Finneman ..... B60N 3/002 248/185.1
7,500,689 B2 3/2009 Pasternak et al.
7,651,111 B2 1/2010 Butler
7,845,667 B2 12/2010 Mahler et al.
8,020,829 B1 * 9/2011 Tamayori ..... B62B 9/26 248/447.2
8,448,581 B2 * 5/2013 Hanna ..... B64D 11/0646 108/44
8,979,190 B2 3/2015 Madrigal et al.
9,883,736 B2 * 2/2018 Dashti ..... A47B 3/10
2006/0032417 A1 * 2/2006 Goschy ..... A61G 5/1054 108/147
2006/0220425 A1 * 10/2006 Becker ..... B60N 3/002 297/188.16
2007/0095582 A1 * 5/2007 Stuijt ..... A61G 5/10 180/65.1
2008/0164729 A1 * 7/2008 Cavanaugh ..... A47C 7/624 297/162
2008/0169285 A1 * 7/2008 Marazita ..... B65D 19/18 220/7
2008/0250983 A1 * 10/2008 Sundarrao ..... A47B 3/00 108/44
2009/0026812 A1 * 1/2009 Figueras Mitjans ... A47C 7/624 297/162
2009/0152336 A1 * 6/2009 D'Amato ..... B65D 5/5021 229/124
2011/0067606 A1 * 3/2011 Sundarrao ..... A61G 5/125 108/44
2011/0233890 A1 * 9/2011 Jutkiewicz ..... A61G 5/1094 280/202
2013/0181490 A1 * 7/2013 Lin ..... F16H 19/001 297/145
2014/0268560 A1 * 9/2014 Duerstock ..... F16M 11/105 361/679.58
2015/0021326 A1 * 1/2015 Giraud ..... B65D 83/0409 220/254.1
2015/0157517 A1 * 6/2015 Okada ..... A47C 7/622 108/44
2015/0173518 A1 * 6/2015 Dudik ..... A47C 7/705 297/16.1
2019/0133855 A1 * 5/2019 Duerstock ..... A61G 5/1094
2019/0175426 A1 * 6/2019 Pengelly ..... A61G 5/1094
2019/0380499 A1 * 12/2019 Kang ..... A47C 7/624
2019/0387884 A1 * 12/2019 Jacobs ..... A47C 1/121
2020/0046128 A1 * 2/2020 Sramek ..... A47C 27/10
2021/0093494 A1 * 4/2021 Duerstock ..... A61G 5/04

* cited by examiner

RETRACTABLE STORAGE DEVICES

TECHNICAL FIELD

The present specification generally relates storage containers for wheelchairs or other types of chairs and, more specifically, to retractable storage devices which can be movable between a stowed position and raised position.

BACKGROUND

Additional storage space may be desirable by an operator of a wheelchair. For example, if a wheelchair operator would like an area to store their cellular device, books, or a laptop computer, then the operator may place a storage container on the side of the wheelchair by the armrest, or use a backpack or bag which is arranged to the back of the wheelchair. Accordingly, if a storage container is placed on the side of the wheelchair, this would increase the overall width of the wheelchair, and could prevent the operator from passing through certain doorways due to the increased width. If the operator used a backpack to store their belongings on the back of the wheelchair, it would become difficult to easily access anything contained within the backpack due to its location on the back of the wheelchair. The other option an operator could use is to hold their belongings, which would not be feasible for most wheelchair operators.

Accordingly, there is a need for a retractable storage device that does not increase the width of the wheelchair or chair the device is secured to, and has both a stowed and raised position that is easily accessible to a person seated in the chair or wheelchair.

SUMMARY

In one embodiment, a retractable storage device for an armrest of a chair includes a vertically extending arm assembly including a first distal end and a second distal end, a horizontally extending arm assembly including a first distal end and a second distal end, a middle connector, and a storage container. The second distal end of the vertically extending arm assembly is pivotally secured to the middle connector, and the first distal end of the horizontally extending arm assembly is pivotally secured to the middle connector. The retractable storage device is moveable between a stowed position and a raised position. The storage container is coupled to the second distal end of the horizontally extending arm assembly, where the storage container is stowed beneath the armrest when the retractable storage device is moved to the stowed position.

In another embodiment, a retractable storage device includes a base, a vertically extending arm assembly, a middle connector, a horizontally extending arm assembly, a storage container base, and a storage container. The base is secured to the underside surface of the armrest. The vertically extending arm assembly includes a first distal end and a second distal end. The first distal end of the vertically extending arm assembly is pivotally secured to the base. The middle connector is arranged such that the second distal end of the vertically extending arm assembly is pivotally secured to the middle connector. The horizontally extending arm assembly includes a first distal end and a second distal end. The first distal end of the horizontally extending arm assembly is pivotally secured to the middle connector. The storage container base is arranged such that the storage container is pivotally secured to the storage container base, and the second distal end of the horizontally extending arm assembly is pivotally secured to the storage container base.

These and additional features provided by the embodiments described herein will be more fully understood in view of the following detailed description, in conjunction with the drawings.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be understood when read in conjunction with the following drawings, where like structure is indicated with like reference numerals and in which:

DETAILED DESCRIPTION

Figure 1A:
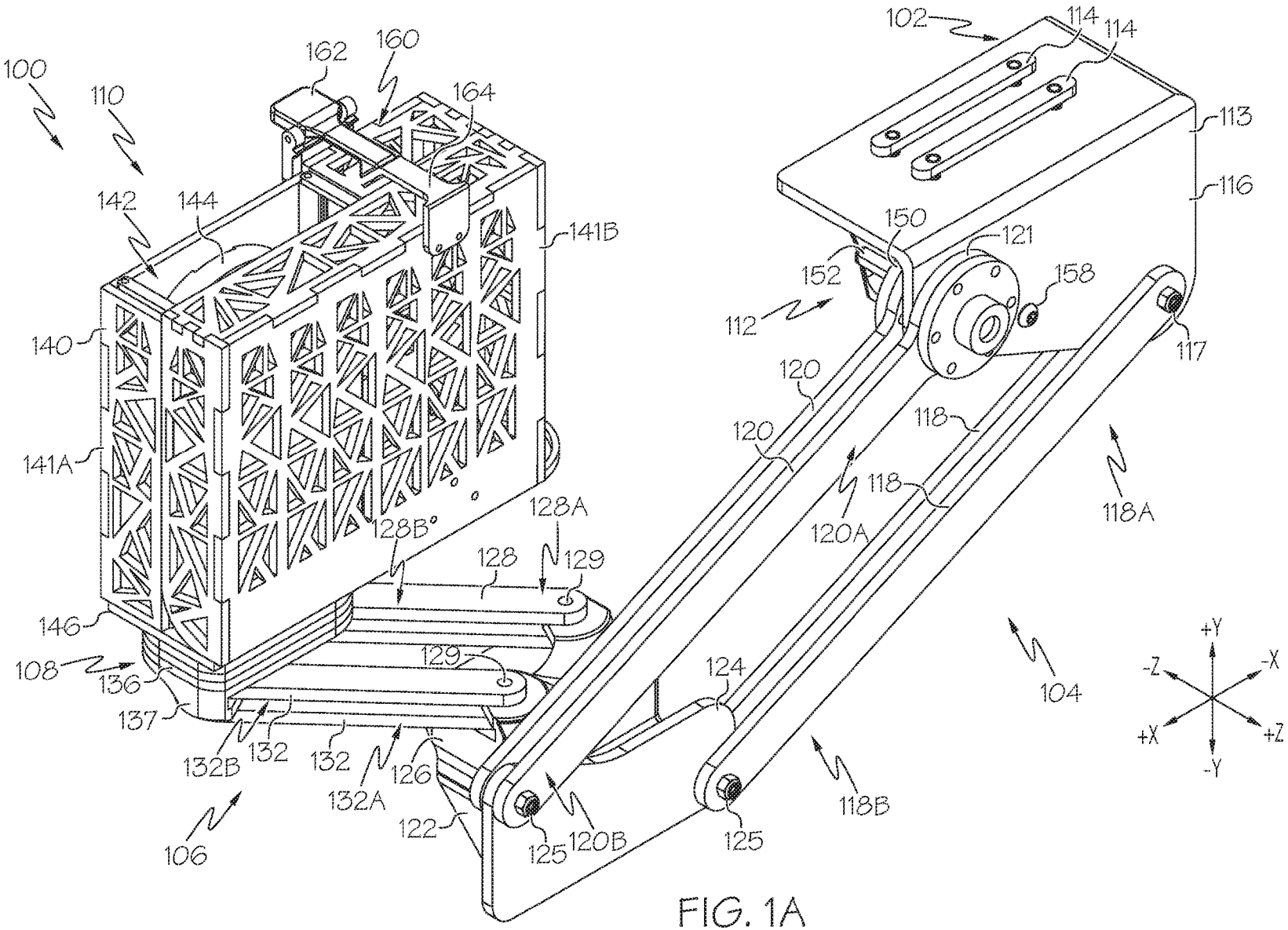
FIG. 1A schematically depicts a front perspective view of a retractable storage device in a partially raised position, according to one or more embodiments shown or described herein.

Embodiments of the present disclosure are directed to retractable storage devices which may be coupled to an underside surface of an armrest of a wheelchair or other type of chair. The retractable storage device is moveable between a stowed position and a raised position. A storage container of the retractable storage device is stowed beneath the armrest when the retractable storage device is moved to the stowed position. As will be described in greater detail herein, the retractable storage device may be easily and securely attached to the armrest of the wheelchair without adding any additional width to the armrest, and thus the wheelchair. Furthermore, vertical movement of the retractable storage device can be achieved via a motor in order to place the storage container within greater accessible reach to an operator of the wheelchair. Various embodiments of wheelchairs having a retractable storage device will be described in greater detail herein.

As used herein, the term "longitudinal direction" refers to the forward-rearward direction of the vehicle (i.e., in the +/−X-direction of the depicted coordinate axes). The term "lateral direction" refers to the cross-vehicle direction of the vehicle (i.e., in the +/−Z-direction of the depicted coordinate axes), and is transverse to the vehicle longitudinal direction. The term "vertical direction" refers to the upward-downward direction of the vehicle (i.e., in the +/−Y-direction of the depicted coordinate axes). As used herein, "upper" and "above" are defined as the positive Y direction of the coordinate axis shown in the drawings. "Lower" and "below" are defined as the negative Y direction of the coordinate axis shown in the drawings.

Figure 1B:
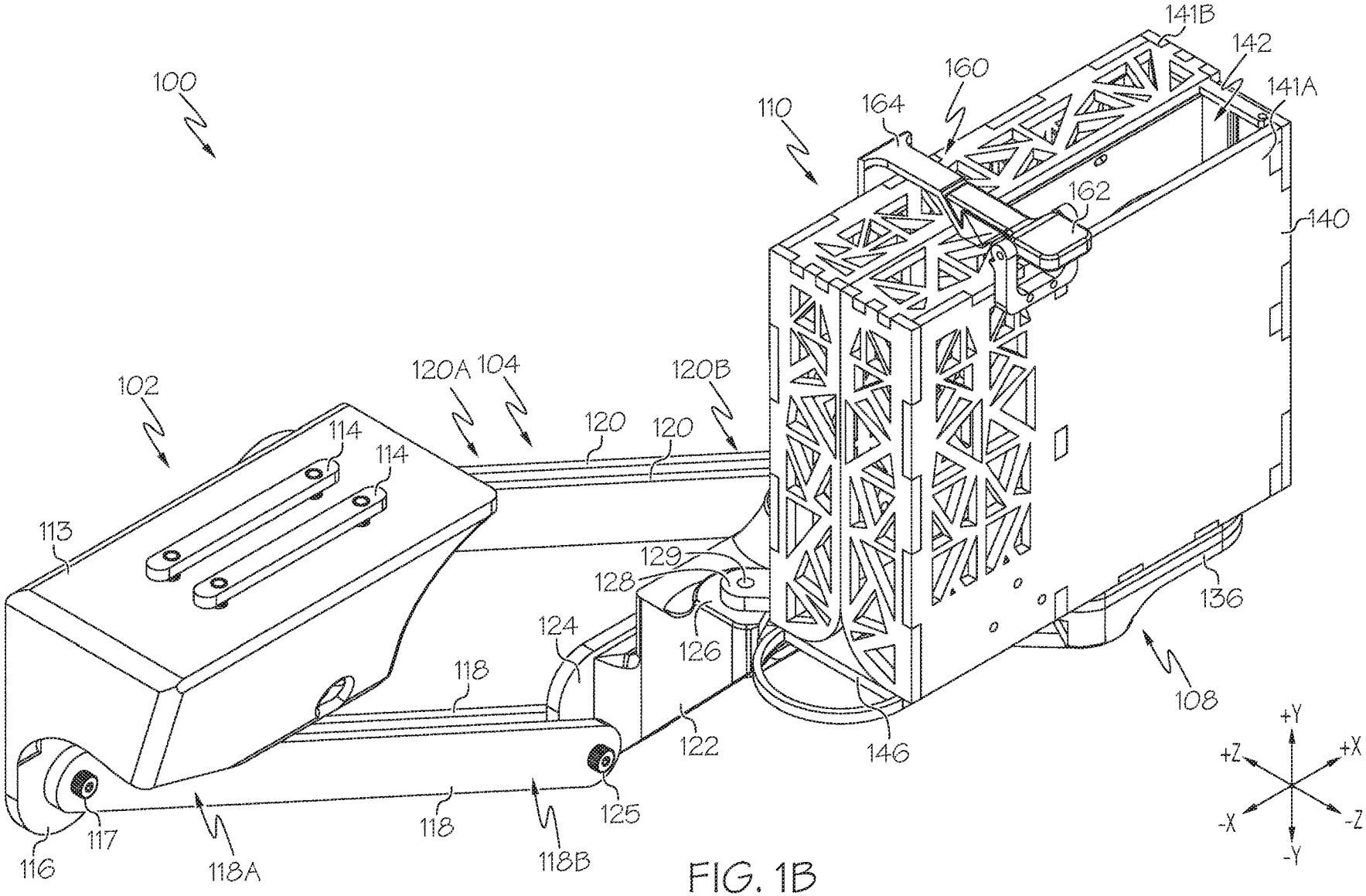
FIG. 1B schematically depicts a back perspective view of the retractable storage device of FIG. 1A in a partially raised position, according to one or more embodiments shown or described herein.

Referring now to FIGS. 1A and 1B, a front perspective view of an embodiment of a retractable storage device 100 in a partially raised position is generally depicted. As illustrated, the retractable storage device 100 may include a base assembly 102, a vertically extending arm assembly 104, a horizontally extending arm assembly 106, a storage container base assembly 108, a storage container assembly 110, a motor assembly 112, and a middle connector 122. As will be described in greater detail herein, the retractable storage device 100 is configured to be moveable between a stowed positioned underneath an armrest of a wheelchair, and a raised position where the storage container assembly 110 is easily accessible to an operator of the wheelchair. Although embodiments are described herein in the context of wheelchairs, it should be understood that the retractable storage devices 100 described herein may be employed in any type of chair having an armrest.

Referring still to FIGS. 1A and 1B, the base assembly 102 may include a base 113, mounting arms 114, and a flange 116. The mounting arms 114 may be secured to the base 113 and may be configured to secure the base 113 to an armrest of a wheelchair. It should be appreciated that mounting arms 114 can be any suitable mounting means, such as bolts or tabs, without departing from the scope of the present disclosure. It should also be appreciated that base 113 can be formed from an integral piece with an armrest of a wheelchair. In some embodiments, flange 116 may be a portion of the base 113 that extends downward in the +/−Y direction. Flange 116 may be configured to allow vertically extending arm assembly 104 to secure to the base 113.

Referring still to FIGS. 1A and 1B, the vertically extending arm assembly 104 may include lower arms 118 and upper arms 120. However, it should be appreciated that more of fewer arms may be used within the vertically extending arm assembly 104. For example, in some embodiments, the vertically extending arm assembly 104 may include a single lower arm 118 and a single upper arm 120, instead of a pair of lower arms 118 and a pair of upper arms 120. The lower arms 118 and upper arms 120 may be arranged parallel to one another and arranged to pivot in the X-Y plane. First distal ends 118A of the lower arms 118 may be pivotally secured to the flange 116 of the base 113 by a bolt 117. Additionally, first distal ends 120A of the upper arms 120 may be pivotally secured to the flange 116 of base 113 by mounting hubs 121. As will be described in greater detail below, the mounting hubs 121 may be non-rotatably secured to drive wheels 150, with the drive wheels 150 non-rotatably secured to a driveshaft 152. A middle connector 122 may include a flange 124 and a flange 126. Second distal ends 118B of the lower arms 118 may be pivotally secured to the flange 124 of the middle connector 122 by a bolt 125, or other coupling means. Additionally, second distal ends 120B of the upper arms 120 may be pivotally secured to the flange 124 of the middle connector 122 by a bolt 125, or other coupling means.

The horizontally extending arm assembly 106 may include back arms 128 and front arms 132. However, it should be appreciated that more of fewer arms may be used within the horizontally extending arm assembly 106. For example, in some embodiments, the horizontally extending arm assembly 106 may include a single back arm 128 and a single front arm 132, instead of a pair of back arms 128 and a pair of front arms 132. The back arms 128 and front arms 132 may be arranged parallel to one another and arranged to pivot in the X-Z plane. First distal ends 128A of the back arms 128 may be pivotally secured to the flange 126 of the middle connector 122 by a bolt 129. Additionally, first distal ends 132A of the front arms 132 may be pivotally secured to the flange 126 of middle connector 122.

The storage container base assembly 108 may include base 136 and flange 137. Second distal ends 128B of the back arms 128 may be pivotally secured to the flange 137 of the base 136. Additionally, second distal ends 132B of the front arms 132 may be pivotally secured to the flange 137 of the base 136.

It is noted that the lower arms 118, upper arms 120, back arms 128, and front arms 132 and/or various components thereof may be made from a variety of materials. For example, in one non-limiting embodiment the lower arms 118, upper arms 120, back arms 128, and front arms 132 are made from stamped metal. In some embodiments, the lower arms 118, upper arms 120, back arms 128, and front arms 132 are made from rigid plastic.

Referring still to FIGS. 1A and 1B, the storage container assembly 110 may be pivotally secured to base 136 of the storage container base assembly 108. The storage container assembly 110 may include storage container 140. Storage container 140 may include a first shell 141A, a second shell 141B, and a latch assembly 160. The first shell 141A and the second shell 141B may be pivotally secured to a storage container base plate 146, opposite one another. When the first shell 141A and the second shell 141B are abutted against one another, an internal cavity is be formed between the first shell 141A and second shell 141B. In some embodiments, an operator of a wheelchair may store his or her belongings within the internal cavity formed between the first shell 141A and second shell 141B.

The latch assembly 160 may include a male end 162 and a female end 164. In some embodiments, the latch assembly 160 is designed to keep the first shell 141A and second shell 141B abutted against one another to prevent any items contained within the cavity from falling out of the storage container 140. In some embodiments, 1 charging port 142 may be arranged within first shell 141A or the second shell 141B for an operator of a wheelchair to place their phone within the charging port 142. For example, a wireless charging induction coil 144 may also be arranged within the charging port 142.

Figure 2:
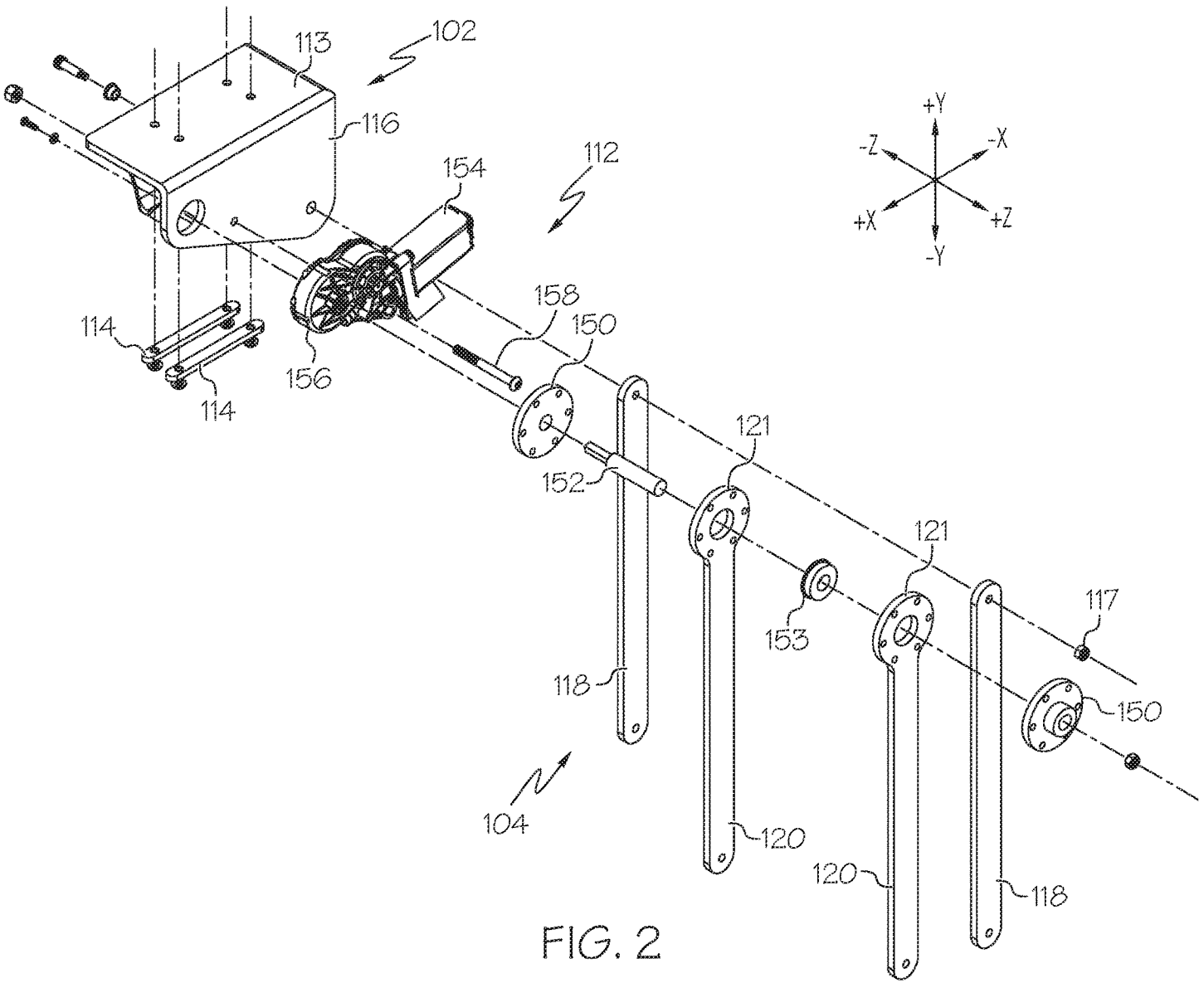
FIG. 2 schematically depicts an exploded view of a base assembly, a vertically extending arm assembly, and a motor assembly of the retractable storage device of FIG. 1A, according to one or more embodiments shown or described herein.

Referring now to FIG. 2, an exploded view of the base assembly 102, the vertically extending arm assembly 104, and the motor assembly 112 of the retractable storage device 100 is depicted. The motor assembly 112 may include drive wheels 150, a driveshaft 152, a spacer bearing 153, a motor 154, a gearbox 156, and a bolt 158. The motor 154 and the gearbox 156 may be arranged within base 113, and secured within the base 113 by bolt 158. In some embodiments, the gearbox 156 may be designed to prevent rotation of the upper arms 120 without movement from the motor 154. More specifically, the gearbox 156 may include a worm gear (not shown) being driven by the motor 154, which in turn drives an axial gear (not shown) contained within the gearbox 156. The driveshaft 152 may be non-rotatably connected with the axial gear of the gearbox 156. The driveshaft 152 may be configured to transfer rotation power from the motor 154 and gearbox 156, to the drive wheels 150. In some embodiments, the upper arms 120 may include mounting hubs 121, which correspond to the drive wheels 150. The drive wheels may be non-rotatably connected to the driveshaft 152 and the upper arms 120 via the mounting hubs 121. In some embodiments, the motor 154 is communicatively connected to a power supply of the wheelchair, but it should be appreciated that the motor 154 can have its own separate power supply.

Figure 3A:
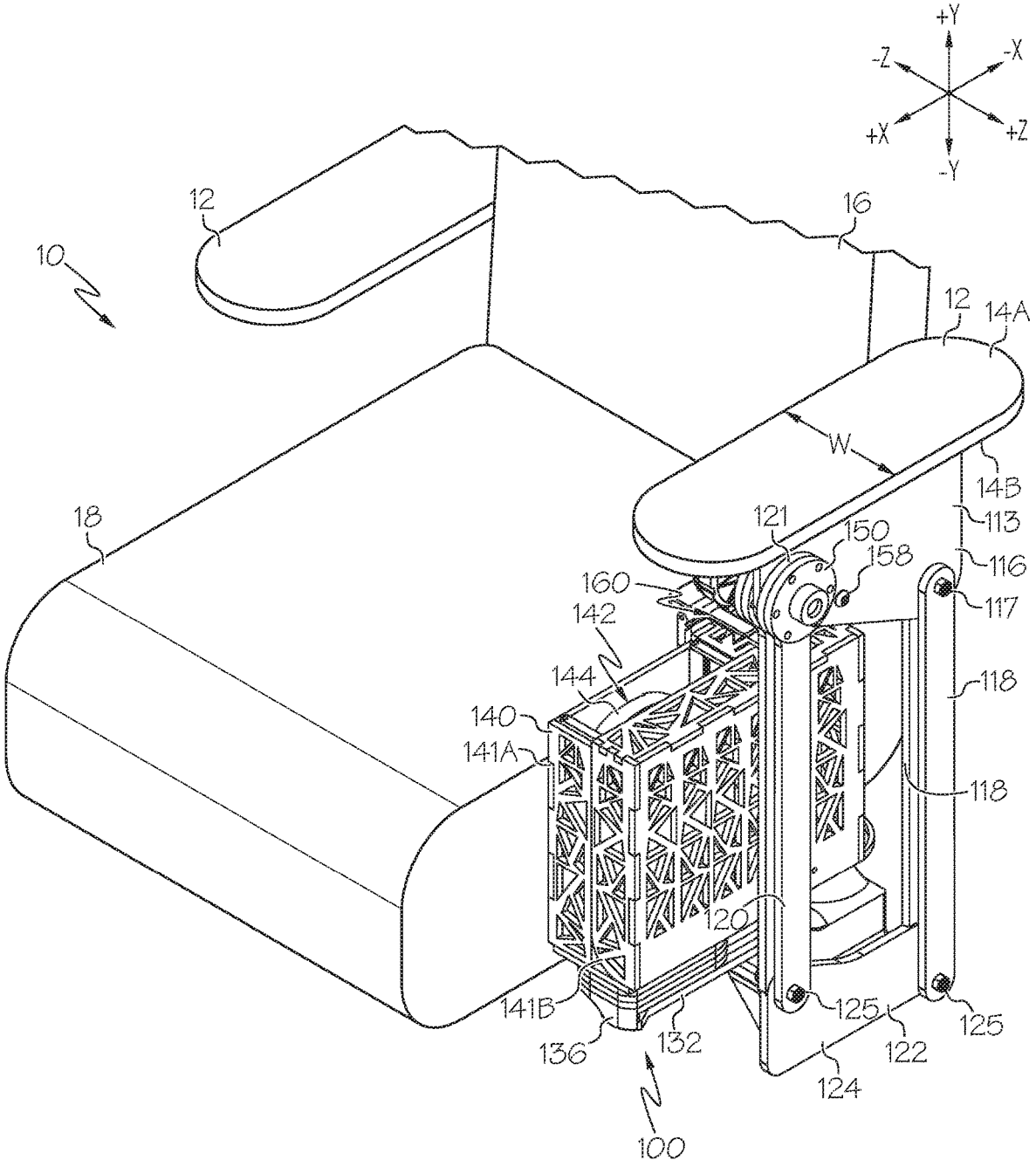
FIG. 3A schematically depicts the retractable storage device of FIG. 1A in a stowed position secured to a wheelchair, according to one or more embodiments shown or described herein.
Figure 3B:
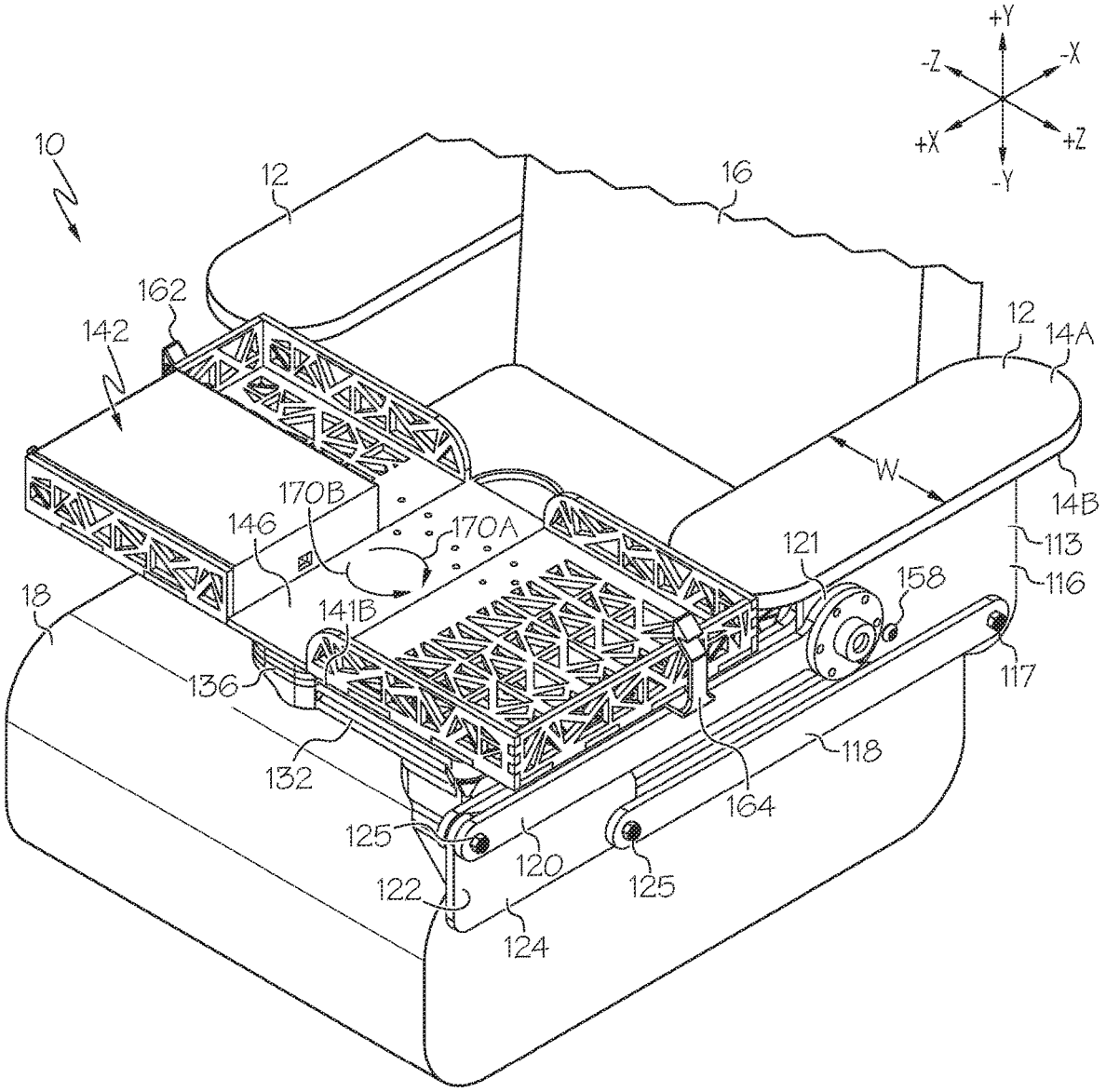
FIG. 3B schematically depicts the retractable storage device of FIG. 1A in a raised position secured to a wheelchair, according to one or more embodiments shown or described herein.

Referring now to FIGS. 3A and 3B, the retractable storage device 100 may be secured to the armrest 12 of a wheelchair 10 (or other type of chair). FIG. 3A depicts the retractable storage device 100 in a stowed position while secured to the wheelchair 10. FIG. 3B depicts the retractable storage device 100 in a raised position while secured to the wheelchair 10. The wheelchair 10 includes armrests 12, back portion 16, and seat portion 18. The armrests 12 may include a top surface 14A and a bottom surface 14B, with the retractable storage device 100 secured to the bottom surface 14B of the armrest 12. In some embodiments, the retractable storage device 100 is secured to the armrest 12 by mounting arms 114, but it should be appreciated that the retractable storage device 100 can be secured to the armrest 12 is a plurality of ways, including straps, bolts, or by having the base 113 being integral with the armrest 12.

In the stowed position, the retractable storage device 100 is arranged underneath the armrest 12 such that the width W of the armrest is greater than the width of the retractable storage device 100 in the +/−Z direction. Since the width W of the armrest 12 is greater than the width of the retractable storage device 100 when attached to the armrest 12, the wheelchair 10 may still have the same width as before attachment because an increase in overall width has not occurred due to the addition of the retractable storage device 100. Additionally, in the stowed position, the retractable storage device 100 is arranged vertically below the armrest 12 in the +/−Y direction. In some embodiments, when the retractable storage device 100 is in the stowed position (as shown in FIG. 3A), the operator of the wheelchair 10 may still access his or her cellular device, or any item, stored within the charging port 142 arranged within the storage container 140.

Referring still to FIGS. 3A and 3B, as noted above, the retractable storage device 100 may be moveable between a stowed and raised position. In order to transition the retractable storage device 100 from the stowed position to the raised position, the operator of the wheelchair 10 may activate the motor 154. In some embodiments, the motor 154 may be activated by a variety of means, including a button communicatively connected with the motor 154 and a power supply, by a remote control, or if no motor is present, by physically rotating the lower arms 118 and upper arms 120 of the vertically extending arm assembly 104. The vertically extending arm assembly 104 is fully extended once the lower arms 118 and upper arms 120 are horizontal, or said another way, parallel to the +/−X axis. Once the vertically extending arm assembly 104 is fully extended, the operator of the wheelchair 10 can extend the horizontally extending arm assembly 106. The horizontally extending arm assembly 106 is fully extended once the back arms 128 and front arms 132 are parallel to the back portion 16 and arranged over the seat portion 18, or said another way, when the back arms 128 and front arms 132 are parallel to the +/−Z axis. In some embodiments, the horizontally extending arm assembly 106 can include a motor similar to the vertically extending arm assembly 104.

In some embodiments, after both the vertically extending arm assembly 104 and the horizontally extending arm assembly 106 are fully extended, the latch assembly 160 can be released to let the storage container 140 unfold into a tray-like apparatus arranged over the seat portion 18 of the wheelchair 10. The unfolded storage container 140 can include hook-and-loop fasteners or various other securement means to keep items secured within the storage container 140. Since the storage container base plate 146 is pivotally secured to the base 136, the storage container 140 can be rotated in the directions 170A or 170B if the operator of the wheelchair needs to arrange the storage container 140 away from the seat portion 18.

In order to transition the retractable storage device 100 from the raised position to the stowed position, the operator of the wheelchair 10 latches together the first shell 141A and the second shell 141B using the latch assembly 160. Once the storage container 140 is secured, the operator of the wheelchair 10 can collapse the horizontally extending arm assembly 106. The horizontally extending arm assembly 106 is fully collapsed once the back arms 128 and front arms 132 are parallel to the armrest 12, or said another way, when the back arms 128 and front arms 132 are parallel to the +/−X axis. Once the horizontally extending arm assembly 106 is fully collapsed, the operator of the wheelchair 10 may activate the motor 154 in order to fully collapse the vertically extending arm assembly 104. The vertically extending arm assembly 104 is fully collapsed once the lower arms 118 and upper arms 120 are vertical and perpendicular with the armrest 14, or said another way, parallel to the +/−Y axis. The retractable storage device 100 is in the stowed position when bot the vertically extending arm assembly 104 and the horizontally extending arm assembly 106 are fully collapsed and the storage container 140 is arranged beneath the armrest 14.

It should now be understood that embodiments described herein are directed to a retractable storage device which may be coupled to an underside surface of an armrest of a wheelchair or other type of chair. The retractable storage device is moveable between a stowed position and a raised position. A storage container of the retractable storage device is stowed beneath the armrest when the retractable storage device is moved to the stowed position. The retractable storage device may be easily and securely attached to the armrest of the wheelchair without needing to add any additional width to the arm rest. Furthermore, vertical movement of the retractable storage device can be achieved via a motor in order to place the storage container within greater accessible reach to an operator of the wheelchair.

It will be apparent to those skilled in the art that various modifications and variations can be made to the embodiments described herein without departing from the spirit and scope of the claimed subject matter. Thus it is intended that the specification cover the modifications and variations of the various embodiments described herein provided such modification and variations come within the scope of the appended claims and their equivalents.

The invention claimed is:

1. A retractable storage device for an armrest of a chair, comprising:

a vertically extending arm assembly, comprising:
- a first distal end; and
- a second distal end;

a horizontally extending arm assembly, comprising:
- a first distal end; and
- a second distal end;

a middle connector, wherein the second distal end of the vertically extending arm assembly is pivotally secured to the middle connector, and the first distal end of the horizontally extending arm assembly is pivotally secured to the middle connector, wherein the retractable storage device is moveable between a stowed position and a raised position;

a storage container coupled to the second distal end of the horizontally extending arm assembly, wherein the storage container is stowed beneath the armrest when the retractable storage device is moved to the stowed position;

a base secured to an underside surface of the armrest, wherein the first distal end of the vertically extending arm assembly is pivotally secured to the base; and a storage container base, wherein the storage container is pivotally secured to the storage container base, and the second distal end of the horizontally extending arm assembly is pivotally secured to the storage container base, wherein the vertically extending arm assembly pivots to a horizontal orientation away from the wheelchair.

2. The retractable storage device of claim 1, wherein a motor is arranged within the base.

3. The retractable storage device of claim 2, wherein a driveshaft of the motor is non-rotatably secured to the first distal end of the vertically extending arm assembly.

4. The retractable storage device of claim 1, wherein the vertically extending arm assembly comprises at least two arms that rotate in an X-Y plane.

5. The retractable storage device of claim 4, wherein the at least two vertically extending arms are parallel to one another.

6. The retractable storage device of claim 1, wherein the horizontally extending arm assembly comprises at least two arms that rotate in an X-Z plane.

7. The retractable storage device of claim 6, wherein the at least two horizontally extending arms are parallel to one another.

8. The retractable storage device of claim 1, wherein the storage container comprises:

a base plate pivotally secured to the storage container base;

a first shell pivotally secured to the base plate; and a second shell pivotally secured to the base plate opposite the first shell, wherein the first shell and the second shell form a cavity arranged between the first shell and the second shell.

9. The retractable storage device of claim 8, wherein the storage container further comprises a latch assembly, wherein the latch assembly retains the first shell and the second shell abutted together when the retractable storage device is in the stowed position.

10. The retractable storage device of claim 8, wherein the storage container rotates in two directions.

11. The retractable storage device of claim 8, further comprising a charging port within one or more of the first shell and the second shell.

12. The retractable storage device of claim 1, wherein the storage container comprises an internal cavity capable of storing belongings.

* * * * *